US006762405B1

(12) United States Patent
Zhao et al.

(10) Patent No.: US 6,762,405 B1
(45) Date of Patent: Jul. 13, 2004

(54) MATRIX ASSISTED LASER IONIZATION SYSTEM

(75) Inventors: Xiaojie Zhao, Stonybrook, NY (US); Shane Shizhou Zhang, Stonybrook, NY (US); Alan Jinlin Xu, Bay Port, NY (US); Yusong Yin, Stonybrook, NY (US)

(73) Assignee: Photonics Industries International, Inc., Bohemia, NY (US)

( * ) Notice: Subject to any disclaimer, the term of this patent is extended or adjusted under 35 U.S.C. 154(b) by 0 days.

(21) Appl. No.: 10/448,631

(22) Filed: May 30, 2003

(51) Int. Cl.[7] ..... H01J 49/04
(52) U.S. Cl. ..... 250/288
(58) Field of Search ..... 250/288

(56) References Cited

U.S. PATENT DOCUMENTS 5,117,108 A * 5/1992 Muller et al. ..... 250/288
6,175,112 B1 * 1/2001 Karger et al. ..... 250/288
RE37,485 E 12/2001 Vestal
6,617,577 B2 * 9/2003 Krutchinsky et al. ..... 250/288

* cited by examiner

*Primary Examiner*—Jack Berman
(74) *Attorney, Agent, or Firm*—James A. Quinton

(57) ABSTRACT

A matrix assisted laser desorption and ionization system is provided. The system includes a mass spectrometer for analyzing at least one sample. The mass spectrometer includes a sample receiving chamber for receiving a sample under a vacuum. A UV laser is provided for producing a UV beam along a first beam path that does not intersect with the sample. A beam expander is provided in optical communication with the UV laser beam to expand the diameter of the beam. A focusing system is provided in optical communication with the beam expander to focus the laser beam propagating from the beam expander to a predetermined minimum spot size. The focusing system is located along the path of the beam propagating from the beam expander so that the beam strikes the approximate optical center of the focusing system. A high reflecting mirror is provided in optical communication with the focused beam propagating from the focusing system to direct the focused beam to strike the sample at a preselected strike point. Desirably, the laser, the beam expander and the focusing system, preferably a lens, are mounted to the same mounting surface or to parallel mounting surfaces that are joined together to form an integral structure.

11 Claims, 4 Drawing Sheets

MATRIX ASSISTED LASER IONIZATION SYSTEM

TECHNICAL FIELD

The present invention relates to mass spectrometer analysis systems and a laser system for use therein.

BACKGROUND OF THE INVENTION

Matrix assisted desorption and ionization systems have been developed to desorb and ionize large molecules and with the aid of a mass spectrometer to determine the molecular weight of large molecules e.g. DNA fragments, proteins or other large molecules. See: U.S. Pat. No. RE 37,485 and U.S. Pat. No. 5,288,644. Such devices generally require the introduction of a sample into a target area (sample chamber) that is kept under vacuum. A laser beam is then directed at the target to desorb and ionize the sample.

A problem has arisen with the use of the laser in such systems. The laser beam in such systems must have its spot size adjusted from time to time. As shown in FIG. 4, prior art matrix assisted desorption systems have included a mass spectrometer, a sample chamber for receiving one or more samples under vacuum and a focusing tens. Prior art focusing lenses 72 have been attached to the mass spectrometer by a plurality of rods 74 extending from the mass spectrometer. A laser 70, an attenuator 76, and a folding mirror 78 are mounted to a horizontal plate and aligned. The focusing lens 72 is located in a different plane than the horizontal plate. The plate is mounted to the mass spectrometer 80 by a mounting rod that extends at an acute angle from the mass spectrometer. The laser beam is reflected by the folding mirror 78 to the focusing lens 74 located adjacent the sample chamber.

In such prior art system, adjustment of the laser spot size has been problematical. The focus lens had to be located close to the sample and have a small focal length about 150 mm to 175 mm because the spot size has to be relatively small and adjustable from about 50 $\mu$m to about 200 $\mu$m in diameter. It proved difficult to adjust the spot size and maintain a predetermined strike point because when the focusing lens was moved, the strike point moved.

The spot size was adjusted by moving the focusing lens along the rods. However when such adjustment was made, the strike point of the laser beam moved on the sample. This resulted in having to adjust the angle of reflection of the folding mirror or move the location of the sample. However locating where the laser beam would strike the sample chamber was difficult because the chamber was under a vacuum and was inaccessible. A camera was used to locate the striking point, but it had a limited spatial coverage.

SUMMARY OF THE INVENTION

According to the invention, a matrix assisted laser desorption and ionization system is provided. The system includes a mass spectrometer for analyzing at least one sample. The mass spectrometer includes a sample receiving chamber for receiving a sample under a vacuum. A UV laser is provided for producing a UV beam along a first beam path that does not intersect with the sample A beam expander is provided in optical communication with the UV laser beam to expand the diameter of the beam. A focusing system, desirably a focusing lens, is provided in optical communication with the beam expander to focus the laser beam propagating from the beam expander to a predetermined minimum spot size. The focusing system is located along the path of the beam propagating from the beam expander so that the beam strikes the approximate optical center of the focusing system. A high reflecting mirror is provided in optical communication with the focused beam propagating from the focusing system to direct the focused beam to strike the sample at a preselected strike point. Desirably, the laser, the beam expander and the focusing system, preferably a lens, are mounted to the same mounting surface or to parallel mounting surfaces that are joined together to form an integral structure.

The focusing system is movably mounted desirably along the mounting surface or a parallel mounting surface so that the spot size of the beam at the desired strike point on the sample in the mass spectrometer can be varied. Preferably, the focusing system is mounted on a translation table which allows for easy and accurate movement of the focusing system to adjust the spot size as required. Desirably, the high reflecting mirror is mounted to the same mounting surfaces or to a parallel mounting surface joined together to form an integral structure as are the laser, beam expander and the focusing system. The resulting laser, focusing system and beam expander and optionally the high reflecting mirror form an integral optical module having a unitary structure which can be easily connected to the mass spectrometer after the laser and the associated components have been aligned. When the spot size is changed, there is no substantial change in the strike point on the sample in the sample chamber.

It is an object of the invention to provide a matrix assisted desorption ionization system having a UV laser for producing a beam having a spot size that is adjustable without substantially moving the strike point on the sample chamber of the system.

It is an object of the invention to provide a matrix assisted desorption ionization system having a UV laser for producing a beam having a spot size that is easily adjustable.

It is an object of the invention to provide a matrix assisted desorption ionization system having a UV laser and optic components forming a modular structure which can be aligned prior to attachment to the matrix system.

The preferred embodiment of the present invention is illustrated in the drawings and examples. However, it should be expressly, understood that the present invention should not be limited solely to the illustrative embodiment.

DETAILED DESCRIPTION OF THE INVENTION

Figure 1:
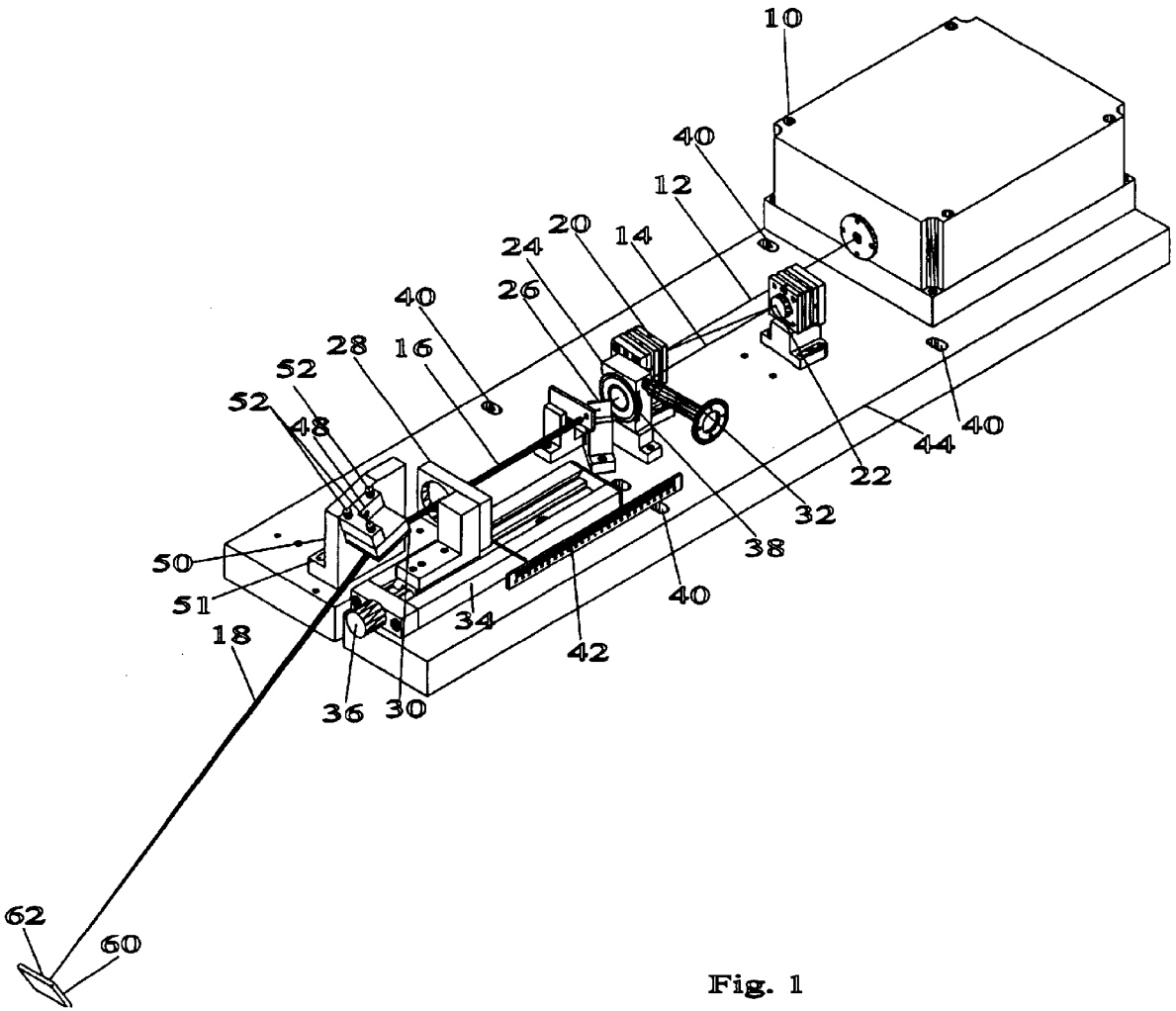
FIG. 1 is a perspective view of a laser module for attachment to a mass spectrometer according to the invention.

According to the invention, a matrix assisted laser desorption and ionization system is provided. The system includes a mass spectrometer for analyzing at least one sample preferably for analyzing multiple samples. The mass spectrometer includes a sample receiving chamber for receiving one or more samples under vacuum. A UV laser is provided for producing a UV beam along a first beam path that does not intersect with the sample. The laser can be selected from numerous convenient sources for example an $N_2$ laser desirably a 3rd harmonic Nd:YAG, Nd:YLF or Nd:$YVO_4$ that will produce a beam of the desired wavelength. Desirably, the laser lases from about 325 nm to 375 nm. A beam expander is provided in optical communication with the UV laser beam to expand the diameter of the beam. Suitable beam expanders are known in the art for example a combination of two mirrors or two lenses or one lens and one mirror desirably two concave mirrors can be used. A focusing system, desirably a focusing lens, is provided in optical communication with the beam expander to focus the laser beam propagating from the beam expander to a predetermined minimum spot size. Desirably the lens has a relatively long focal length of 300 to 400 mm. The focusing system is located along the path of the beam propagating from the beam expander so that the beam strikes the optical center of the focusing system.

A high reflecting mirror is provided in optical communication with the focused beam propagating from the focusing system to direct the focused beam to strike the sample at a preselected strike point. The laser, beam expander and the focusing system, preferably a lens, are mounted to the same mounting surface or to parallel mounting surfaces that are preferably joined together to form an integral structure. The focusing system is movably mounted along the mounting surface or a parallel mounting surface so that the spot size of the beam at the desired striking point on the sample in the mass spectrometer can be varied. Desirably, the high reflecting mirror is mounted to the same mounting surfaces or to a parallel mounting surface joined together to form an integral structure as the laser, beam expander and the focusing system. Preferably, the focusing system is mounted on a translation table which allows easy and accurate movement of the focusing system to adjust the spot size as required. The laser, the focusing system and the beam expander and optionally the high reflecting mirror form an optical module which can be easily connected to the mass spectrometer after the laser and the associated components have been aligned.

Preferably, prior to the installation in the mass spectrometer system, the laser beam expander and focusing system are mounted to the same surface or to parallel mounting surface that are joined together to form an integral module. Desirably, the high reflecting mirror is also similarly mounted. The laser and the optical component are aligned. Thus, the laser is aligned with the beam expander, the focusing system and preferably the reflecting mirror. Since the final location of the module and the sample chamber are fixed and the desired strike point is known, the angle of reflection for the high reflecting mirror can be determined. Thus, the high reflecting mirror can be located at the proper angle to reflect the beam to the strike point on the sample. A fine adjustment can be preferably provided for final alignment of the beam if necessary on the target. The alignment can desirably be done at the factory on an optical table. Optionally, the laser and the optical components can be aligned in the field or laboratory. The module is then connected to the mass spectrometer. In operation, when the spot size needs to be adjusted, a lens system preferably a lens, is moved along the beam path to change the spot size at the target. The spot size can be adjusted without substantially varying the strike point on the sample in the sample chamber.

Figure 2:
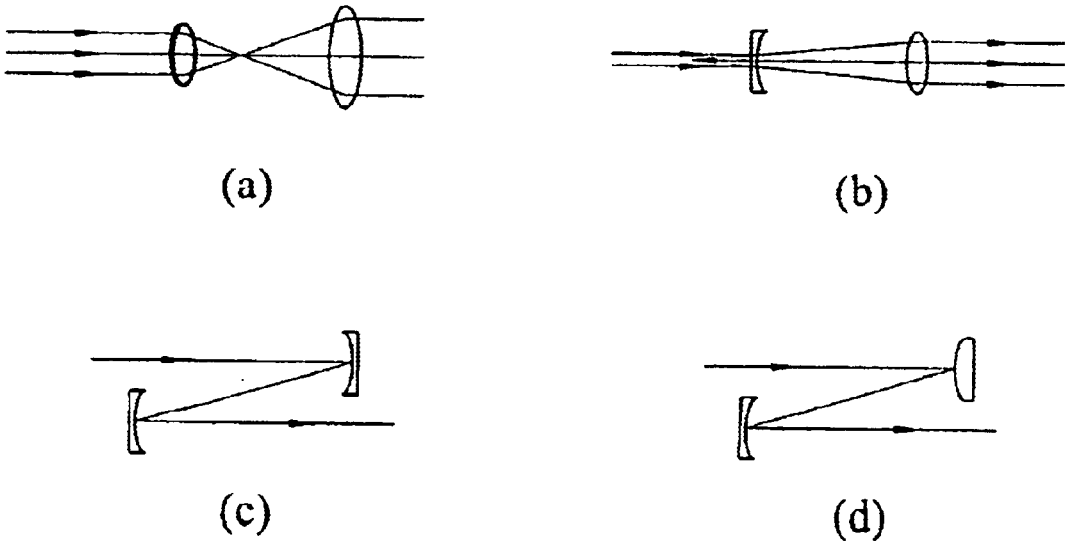
FIGS. 2(*a*)–2(*d*) are a schematic view of a matrix assisted laser desorption and ionization system according to the invention.
Figure 3:
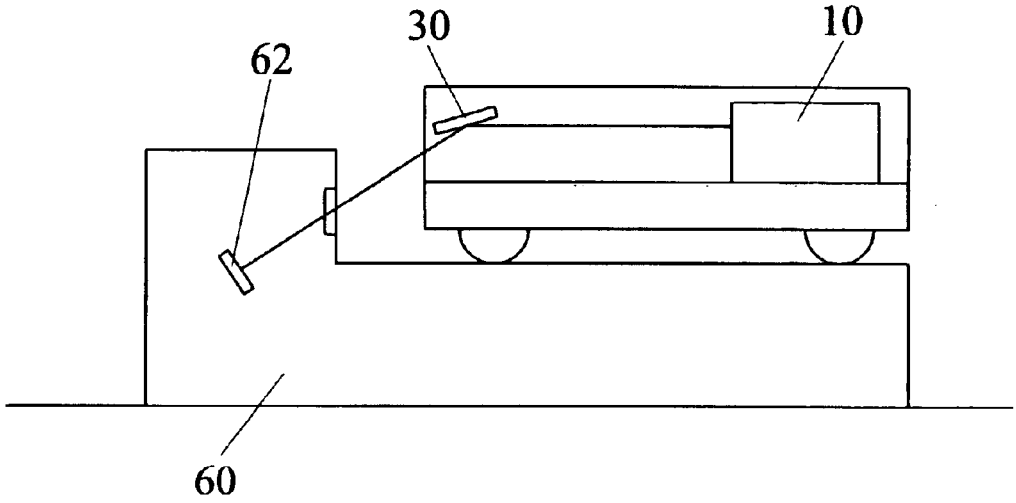
FIG. 3 is a schematic view of beam expanders according to the invention.
Figure 4:
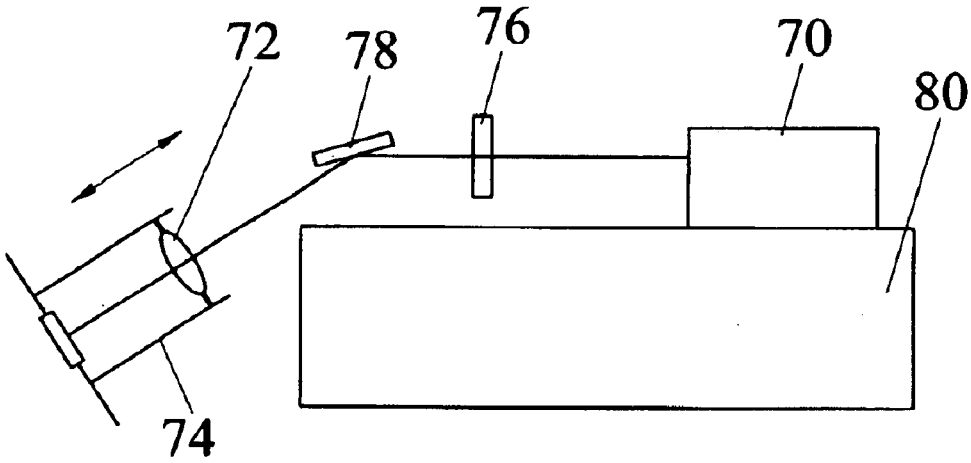
Fig. 4 Prior art
FIG. 4 is a schematic view of a prior art laser desorption ionization system.

Referring to FIG. 1, an integral optical module for attachment to a mass spectrometer system is provided. A laser 10, preferably a solid state UV laser, from which a beam 12 propagates is mounted to mounting plate 44. A beam expander is provided along the path of beam 12. The beam expander can be selected from a variety of beam expanders know in the art. For example the beam expander can be a combination of two mirrors or two lenses or one lens and one mirror desirably two concave mirrors. Thus as shown in FIG. 2*a* two positive (convex) lenses can be used. Optionally as shown in FIG. 2*b* a concave lens and a convex lens or as shown in FIG. 2*c* two concave mirrors or as shown in FIG. 2*d* a concave and a convex mirror can be used. Preferably a beam expander which is composed of mirrors 20 and 22 is provided in optical communication with laser 10. Mirror 20 is desirably a convex or concave mirror, preferably a concave mirror. Mirror 22 is desirably a concave mirror. Optionally, a beam attenuator is provided to regulate the power output of the laser. The beam attenuator is desirably composed of a rotatable waveplate 24 and a brewster mirror 26. The rotatable waveplate 24 rotates the polarization of the beam 14 which has been reflected by mirror 22. Handle 32 is desirably provided to rotate the waveplate to rotate the polarization of the beam 14 as desired. Optionally a motorized waveplate can be used. The brewster mirror 26 which is highly reflective for vertical polarization and highly transmissive for horizontal polarization or visa versa is provided in optical communication with the rotational wave plate 24. As a result, a controlled portion of beam 14 is transmitted by brewster mirror 26. Optionally, other methods of regulating the power delivered to the sample can be used. See U.S. patent application Ser. No. 10/339241 filed Jan. 9, 2003 entitled Variable Power Pulsed Secondary Beam Laser which is hereby incorporated by reference.

A focusing system is provided in optical communication with brewster mirror 26. The focusing system desirably a lens, for example a plano convex lens 28 desirably having a focal length of from 300 to 400 mm is located so that beam 16 strikes the optical center of the lens 28. The focusing system preferably lens 28 is mounted to a translation table 34 which allows for the horizontal movement of the lens system parallel to mounting plate 44 along beam path 16. Knob 36 is provided to move the translation stage horizontally along mounting plate 44 to change the spot size of beam 16 by moving the lens focusing system. Location rod, for example ruler 42 is mounted to the mounting plate 44 so that the position of focus system 28 can be ascertained and the desired spot size of the beam 16 can be obtained by moving the focusing system horizontally through the travel of the translation table. A high reflecting mirror 30 is located in optical communication with the lens 28 to reflect beam 16 downward as beam 18 on a path to strike the sample located in the sample chamber at a preselected strike point.

Laser 10 is secured to a mounting plate 44. Beam expander components 22 and 24 are mounted either directly to mounting plate 44 or to parallel mounting surfaces connected to mounting plate 44. Such parallel mounting surfaces are in turn joined to mounting plate 44 to form an integral, unitary module. Similarly, focusing system preferably lens 28 is joined to mounting plate 44 or to a parallel mounting surface which has been joined together with mounting plate 44. Focus lens 28 is preferably mounted to a translation table 34 which in turn is mounted to mounting plate 44. Preferably, reflecting mirror 30 is also mounted to mounting plate 44 or to a mounting surface which is parallel to mounting plate 44 and is joined with mounting plate 44 to form an integral unitary module. Desirably, mirror 30 is mounted to L-shaped mirror mount 48 which in turn is mounted to mirror mount 50 having a horizontal leg 51 which is parallel to mounting plate 44. Mirror 30 is connected to mounting plate 44 by securing horizontal leg 51 to mounting plate 44. Fine adjustment of the mirror can be accomplished by adjusting one or more mounting screw 52.

In operation, laser beam 12 propagates from laser 10 and is expanded by beam expander composed of mirror 20 to mirror 22. Preferably, the expanded beam 14 continues on a path that is parallel to that of beam 12. Optionally, where other beam expanders are used i.e. FIG. 2*a* the beam path 14 would be a continuation of path 12. Expanded beam 14 is then directed through optional attenuator where the power of the beam can be adjusted as desired. Beam 16, which propagates from the attenuator is then directed to a lens focusing system, preferably focusing lens 28, where it strikes the optical center of the lens. There the spot size can be adjusted by moving the lens 28 along the travel allowed by translation table 34. The beam then having the desired spot size is reflected by mirror 30 which then directs the reflected beam 18 to contact the sample at the desired strike point in the mass spectrometer. The resulting beam 18 has an adjustable controllable spot size. The strike point on the sample in the sample chamber is not substantially changed when the spot size is changed. The optical components and the laser, form an integral unitary module as shown in FIG. 1. The components of the module can be aligned prior to the attachment of the laser and optical components to the mass spectrometer system. Desirably, the laser and optical components are aligned during the manufacture, preferably on an optical table. Optionally, they can be aligned on site prior to the attachment to the mass spectrometer. Fine adjustment of the strike point of the beam can be accomplished by adjusting screws 52. The spot size is varied by turning knob 36 moving the translation table 34 which move focus lens 28 along the path of the beam. The translation table moves in a parallel direction to beam 16 so that beam 16 incidents on lens 28 at the approximate center of the focus lens 28. As a result the strike point 62 on the sample mass spectrometer 60 is not varied when the spot size is changed. Desirably, the mass spectrometer has location pins which are received by alignment holes 40 in mounting plate 44.

The foregoing is considered as illustrative only to the principles of the invention. Further, since numerous changes and modification will occur to those skilled in the art, it is not desired to limit the invention to the exact construction and operation shown and described above, and accordingly all suitable modifications and equivalents may be resorted to, falling within the scope of the invention.

What is claimed is:

1. A matrix-assisted laser desorption ionization system comprising:

a) a sample receiving chamber for receiving one or more samples;

b) a mass spectrometer for analyzing the samples in said chamber;

c) a UV laser for providing a laser beam along a first beam path that does not intersect said sample;

d) a beam expander located along said first beam path for increasing the spot size of said laser beam and directing said laser beam along a second beam path that does not intersect said sample;

e) a focusing system located along said second beam path for focusing said laser beam through a predetermined range of spot sizes; said laser beam incidenting on the approximate optical center of said focusing system;

f) a high reflecting mirror in optical communication with said focusing system for reflecting said focused beam on a third beam path that intersects said sample at a predetermined strike point and at a preselected spot size;

g) said focusing system being movable along said second beam path so that the spot size of said beam point can be varied without substantial change of said strike point.

2. A matrix assisted laser desorption ionization system according to claim 1 further comprising;

h) said laser, said beam expander and said focusing system being mounted to the same mounting surface or to parallel mounting surfaces joined together to form a module;

i) said module being mounted to said mass spectrometer.

3. A matrix assisted laser desorption ionization system according to claim 1 further comprising:

h) said laser, said beam expander, said focusing system and said high reflecting mirror being mounted to the same mounting surface or to parallel mounting surfaces joined together to form a module;

i) said module being mounted to said mass spectrometer.

4. A matrix assisted laser desorption ionization system according to claim 2 wherein said focusing system is mounted to a translation table.

5. A matrix assisted laser desorption ionization system according to claim 4 wherein said range of spot sizes is from 50 to 200 $\mu$m in diameter.

6. A matrix assisted laser desorption ionization system according to claim 4 wherein said translation table moves along a path that is parallel to said second beam path.

7. A matrix assisted laser desorption ionization system according to claim 3, said beam expander further including a first mirror located in said first beam path to reflect said beam;

a second mirror in optical communication with said reflected beam to reflect said beam on said second beam path;

said first mirror being a concave or convex mirrors;

said second mirror being a concave mirror.

8. A matrix assisted laser desorption ionization system according to claim 7 wherein said second beam path is parallel to said first beam path.

9. A matrix assisted laser desorption ionization system according to claim 3, said beam expander further including a first lens located in said first beam path and a second lens in optical communication with said first lens;

said first lens being a concave or convex lens and said second lens being a convex lens.

10. A matrix assisted laser desorption ionization system according to claim 9 wherein said second beam path is an extension of said first beam path.

11. A matrix assisted laser desorption ionization system according to claim 3 wherein said laser beam is aligned with said focusing system and said high reflecting mirror prior to the connection of said module to the mass spectrometer.

* * * * *